US008362924B2

(12) United States Patent
Kim et al.

(10) Patent No.: US 8,362,924 B2
(45) Date of Patent: Jan. 29, 2013

(54) METHOD FOR RUNNING VEHICLES DETECTING NETWORK AND SYSTEM THEREOF

(75) Inventors: Jungsook Kim, Daejeon (KR); Jae Han Lim, Daejeon (KR); Kyeong Tae Kim, Chuncheon-si (KR); Byung Tae Jang, Daejeon (KR); Jeong Dan Choi, Daejeon (KR); Do Hyun Kim, Daejeon (KR); Jaejun Yoo, Daejeon (KR); Kyung Bok Sung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 627 days.

(21) Appl. No.: 12/604,663

(22) Filed: Oct. 23, 2009

(65) Prior Publication Data

US 2010/0156669 A1 Jun. 24, 2010

(30) Foreign Application Priority Data

Dec. 23, 2008 (KR) ..... 10-2008-0131840

(51) Int. Cl.
*G08G 1/01* (2006.01)
*G08G 1/07* (2006.01)

(52) U.S. Cl. ..... 340/917; 340/933; 340/935

(58) Field of Classification Search ..... 340/901, 340/905, 917, 918, 995.13, 426.16, 517, 340/521, 988, 991, 993, 937, 935; 348/149, 348/E07.085; 701/423, 424
See application file for complete search history.

(56) References Cited

U.S. PATENT DOCUMENTS

| | | | | |
|---|---|---|---|---|
| 5,940,010 | A * | 8/1999 | Sasaki et al. | 340/901 |
| 7,248,149 | B2 * | 7/2007 | Bachelder et al. | 340/425.5 |
| 7,772,996 | B2 * | 8/2010 | Burns | 340/991 |
| 2007/0211654 | A1 | 9/2007 | Kim et al. | |
| 2009/0256911 | A1 * | 10/2009 | Hakki et al. | 348/149 |

FOREIGN PATENT DOCUMENTS

| | | |
|---|---|---|
| KR | 10-2007-0021437 | 2/2007 |
| KR | 10-2008-0053089 | 6/2008 |

* cited by examiner

*Primary Examiner* — Van T. Trieu
(74) *Attorney, Agent, or Firm* — Staas & Halsey LLP

(57) ABSTRACT

Provided are a method for running a network for vehicle detection and a system thereof. Each vehicle detecting device is classified into a plurality of groups based on information provided from the vehicle detecting devices and control information that activates or deactivates components of the corresponding vehicle detecting devices is set for each group based on the information. Power of a signal transmitting the information is set for each vehicle detecting device.

19 Claims, 7 Drawing Sheets

METHOD FOR RUNNING VEHICLES DETECTING NETWORK AND SYSTEM THEREOF

CROSS-REFERENCE TO RELATED APPLICATION

This application claims priority to and the benefit of Korean Patent Application No. 10-2008-0131840 filed in the Korean Intellectual Property Office on Dec. 23, 2008, the entire contents of which are incorporated herein by reference.

BACKGROUND OF THE INVENTION (a) Field of the Invention

The present invention relates to a method for running a network, and more specifically, it relates to a method for running a network including vehicle detecting devices for a telematics service, and a system thereof.

(b) Description of the Related Art

A loop detector is used as the most generally used vehicle-detecting device in a telematics service, but there is a problem in that the installation and maintenance of the loop detector are expensive. Therefore, a next generation vehicle-detecting technology using a sensor network has been developed. The next generation vehicle detecting technology can be used for a collision avoidance technology, etc., that analyzes a dangerous situation between vehicles at an intersection using a sensor network and assists safe driving.

Since most vehicle detecting devices using the sensor network technology are supplied with power from a battery, low power running technology is very important.

In the existing sensor network system, a method for reducing transmitting/receiving power has been used for low power running. In other words, power consumed by a transceiver is reduced through duty cycling or activation and deactivation of the transceiver in the vehicle detecting device.

The low power operation of the transceiver in the vehicle detecting device as well as the vehicle detecting device itself is very important to minimize the power consumption of the entire system.

However, the sensor network system using the vehicle detecting device according to the related art controls the vehicle detecting devices regardless of traffic and the information of a single controller, such that there is a problem in that the effective operation of energy is difficult. In other words, since the vehicle detecting device according to the related art periodically performs the vehicle detection without using the incoming and outgoing information of a vehicle that is detected by other vehicle detecting devices, the vehicle detecting device itself, and the information of a traffic signal controller, it unnecessarily wastes energy.

Further, the vehicle detecting device according to the related art wastes transmitting and receiving energy by setting a beacon tracking period and receiving a beacon signal transmitted from a controller that controls a sensor network and the transmitting output regardless of the incoming and outgoing vehicle information.

The above information disclosed in this Background section is only for enhancement of understanding of the background of the invention and therefore it may contain information that does not form the prior art that is already known in this country to a person of ordinary skill in the art.

SUMMARY OF THE INVENTION

A technical object of the present invention is to provide a method for running vehicle detecting devices forming a sensor network for telematics service with lower power.

Another technical object of the present invention is to provide a network operating system for a telematics service that is operated with low power.

An exemplary embodiment of the present invention provides, in a system forming a sensor network between vehicle detecting devices that are installed on a road to detect vehicles, a method for running a network linked with a traffic signal controller installed on a road to control the vehicle detecting devices, including: classifying the vehicle detecting devices forming the sensor network into a plurality of groups by the system; determining a current signal state based on traffic signal information provided from the traffic signal controller by the system; generating first activation control information that allows the vehicle detecting device to activate or deactivate a sensing operation of detecting vehicles for each group by the system, based on the current signal state of the determined traffic signal controller and vehicle incoming and outgoing information provided from the vehicle detecting devices of each group; and transmitting the first activation control information including an instruction code indicating the activation or deactivation and an activated or no-activated starting time and duration for each group by the system.

In addition, the method for running a network further includes: calculating traffic based on the incoming and outgoing information of vehicles provided from the vehicle detecting devices of each group; setting at least one of a beacon tracking period that receives a beacon signal provided from the system and transmission power that transmits the detecting signal including the incoming and outgoing information of vehicles for the vehicle detecting device of the corresponding group, based on the calculated traffic and the vehicle incoming and outgoing information; and transmitting at least one of the second activation control information including the predetermined beacon tracking period or the transmission power information including the transmission power to the vehicle detecting devices of the corresponding group.

Another exemplary embodiment of the present invention provides a network operating system linked with a traffic signal controller installed on a road to control vehicle detecting devices when a sensor network is formed between vehicle detecting devices that are installed on the road to detect vehicles, including: a grouping unit that sorts each vehicle detecting device in a plurality of groups; a controller that generates activation control information and transmission output setting information on the vehicle detecting devices for each group, based on one of a current signal state of the traffic signal controller and vehicle incoming and outgoing information provided from the vehicle detecting devices of each group, and traffic information; and a communicating unit that transmits the activation control information and the transmission output setting information to the vehicle detecting devices of each group and receives the vehicle incoming and outgoing information provided from each vehicle detecting device to transmit it to the controller. The activation control information includes at least one of first activation control information that allows the vehicle detecting device of the corresponding group to activate or deactivate the sensing operation of detecting vehicles and second activation control information that allows the vehicle detecting devices to indicate a beacon tracking period receiving a beacon signal provided from the system, and the transmission output setting information includes a transmission power value that allows the vehicle detecting devices to transmit the detecting signal including the vehicle incoming and outgoing information.

DETAILED DESCRIPTION OF THE EMBODIMENTS

Figure 1:
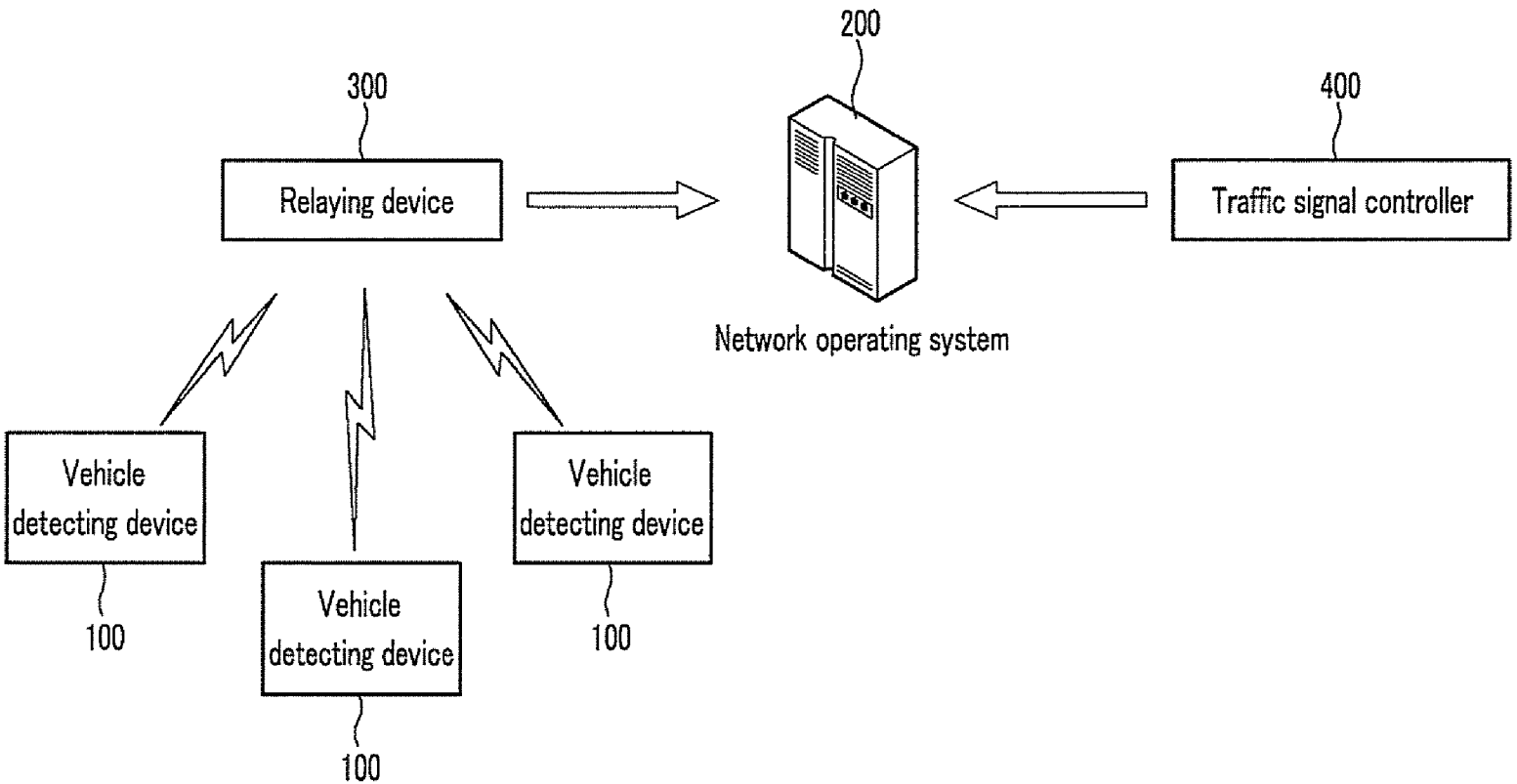
FIG. 1 is a configuration diagram of a vehicle detecting network according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising" will be understood to imply the inclusion of stated elements but not the exclusion of any other elements.

Hereinafter, exemplary embodiments of the present invention will be described with reference to the accompanying drawings.

Figure 2:
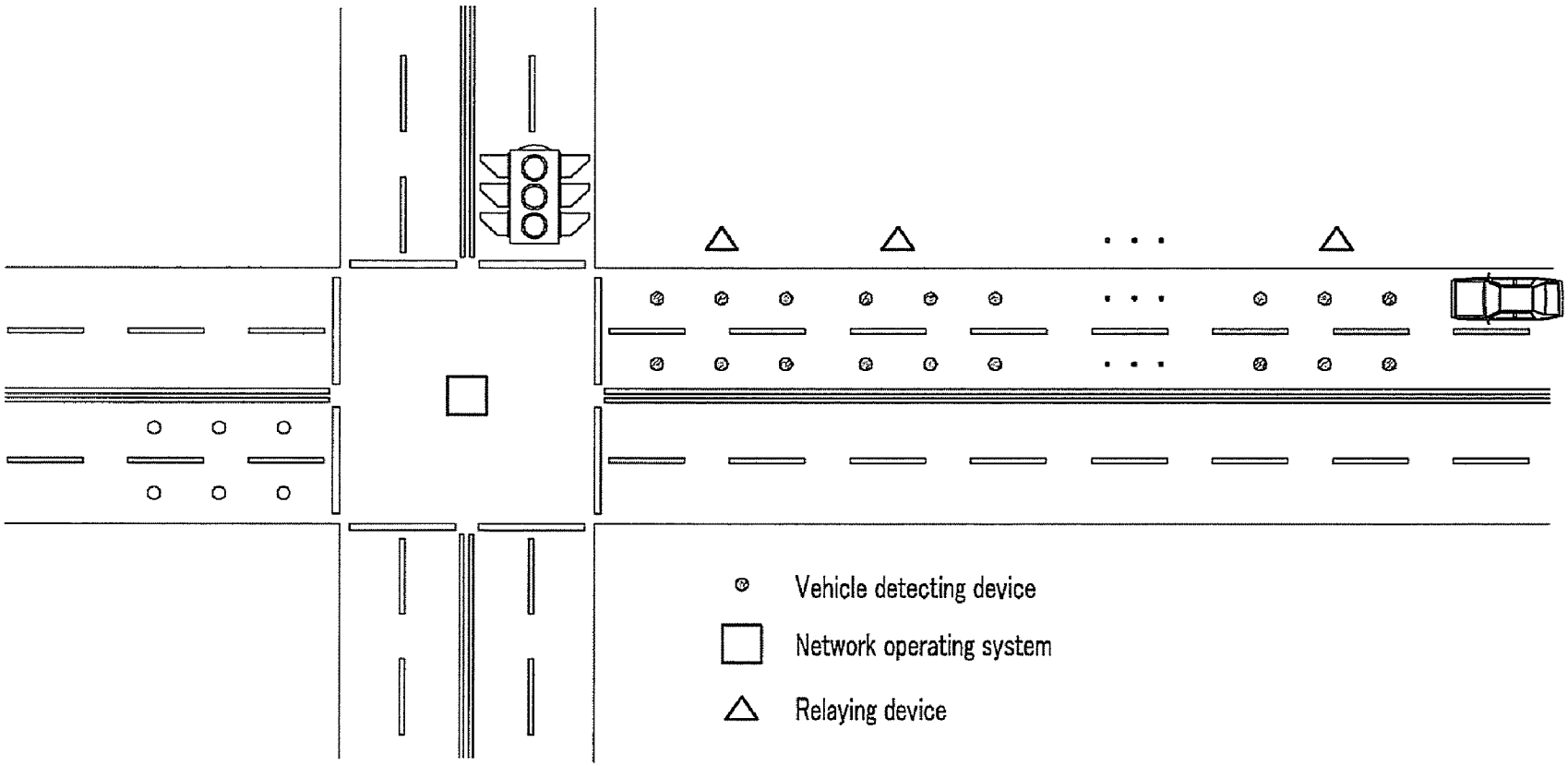
FIG. 2 is a diagram showing an implementation example of the vehicle detecting network according to the exemplary embodiment of the present invention.

FIG. 1 is a configuration diagram of a vehicle detecting network according to an exemplary embodiment of the present invention, and FIG. 2 is a diagram showing an implementation example of the vehicle detecting network according to the exemplary embodiment of the present invention.

As shown in FIG. 1, a vehicle detecting network includes a plurality of vehicle detecting devices 100 that function as sensor nodes, and the vehicle detecting devices are operated according to the control of a network operating system 200 (also referred to as an operation system) according to an exemplary embodiment of the present invention. The vehicle detecting network may include at least one relaying device 300 that relays transmission and reception signals between vehicle detecting devices and between the systems 200 for running a network. The network operating system 200 controls each vehicle detecting device 100 based on traffic signal information provided from at least one traffic signal controller 400 installed on a road, or information detected by the vehicle detecting device.

Each vehicle detecting device 100 configures a vehicle detecting sensor network and is operated by a signal provided from the network operating system 200, and transmits the signal according to the vehicle detection to the system 200 for running a network.

These vehicle detecting devices 100 are installed on a road. For example, these vehicle detecting devices 100 may be installed on a road on which traffic signal controllers are installed. The vehicle detecting devices 100 are installed on a road on which vehicles are travelling to detect vehicles travelling on the corresponding road and to transmit the corresponding signal. The relaying devices 300 are installed at roadsides to receive signals from the vehicle detecting device 100 and to transmit them to the system 200 for running a network. The relaying device 300 can transmit the signals from the vehicle detecting devices to the network operating system via other relaying devices.

Hereinafter, for better comprehension and ease of description, the entire section in which the vehicle detecting devices are installed on a predetermined road is referred to as a vehicle detecting section, wherein the vehicle detecting section is formed of a plurality of detecting sections. In particular, when the vehicle detecting section among the vehicle detecting sections is formed at a ramp of an intersection, the detecting section corresponding to a stop line nearest to the ramp of the intersection is referred to as an outgoing section and the detecting section farthest from the ramp of the intersection is referred to as an incoming section. An area where vehicles can be detected by the vehicle detecting devices is referred to as a detecting area.

As shown in FIG. 2, the vehicle detecting devices 100 are installed at the centers of lanes on the roads connected to the intersections, and the relaying devices 300 may be installed at sides of roads on which the vehicle detecting devices are installed. The network operating system 200 is installed at the intersections, and receives signals from the vehicle detecting devices installed on the corresponding roads from the relaying devices 300 installed at sides of roads connected to each intersection.

Figure 3:
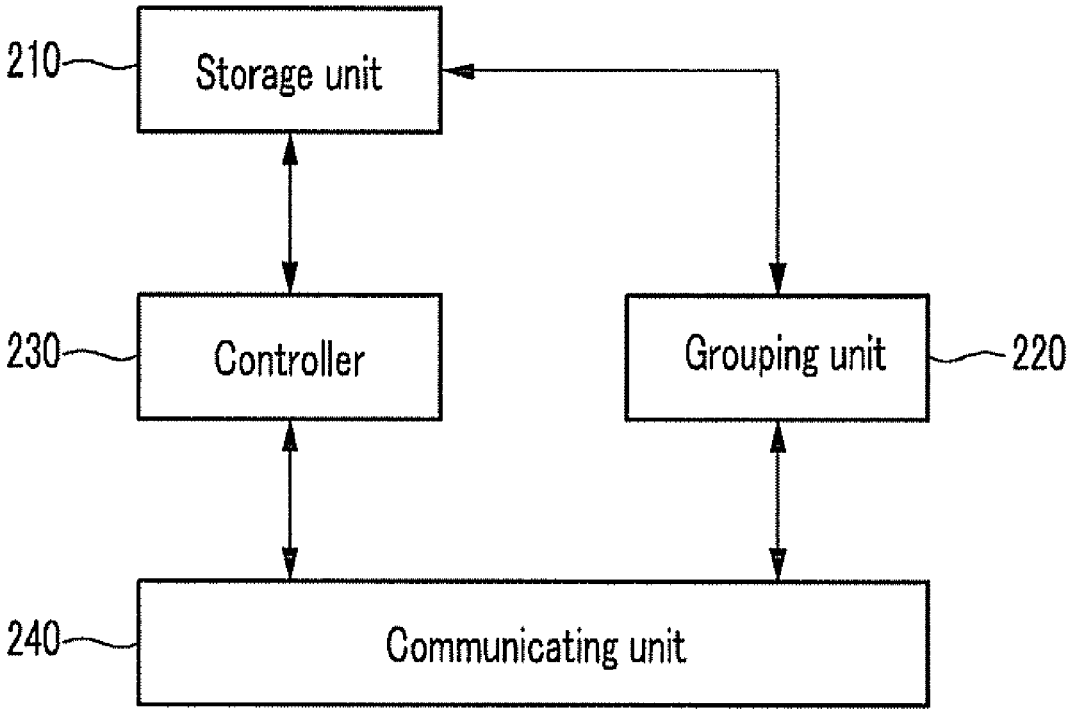
FIG. 3 is a configuration diagram of a network operating system according to the exemplary embodiment of the present invention.

FIG. 3 is a configuration diagram of a network operating system according to the exemplary embodiment of the present invention.

As shown in FIG. 3, the network operating system 200 includes a storage unit 210 that stores various information including installation information on the vehicle detecting devices, a grouping unit 220 that groups the vehicle detecting devices based on the installation information on the vehicle detecting devices and the vehicle detecting information provided from the vehicle detecting devices, a controller 230 that generates activation control information and transmission output setting information on each vehicle detecting device based on the grouping information of the vehicle detecting devices, and a communicating unit 240 that transmits and receives signals to and from the vehicle detecting devices, the relaying devices, and the traffic signal controllers.

The grouping unit 220 groups the vehicle detecting devices in order to make the low power operation more efficient. In detail, the vehicle detecting devices within an area controlled by the corresponding network operating system are grouped based on characteristics of roads on which each vehicle detecting device is installed, the position of the vehicle detecting device, traffic of roads on which each vehicle detecting device is installed, and vehicle incoming and outgoing information of roads on which the corresponding vehicle detecting devices are installed. In detail, the vehicle detecting devices installed in the vehicle detecting section of the predetermined road are classified for each lane in consideration of the vehicle traveling directions of each road, and the vehicle detecting devices installed at the corresponding lanes for each lane are classified into a plurality of groups.

Figure 4:
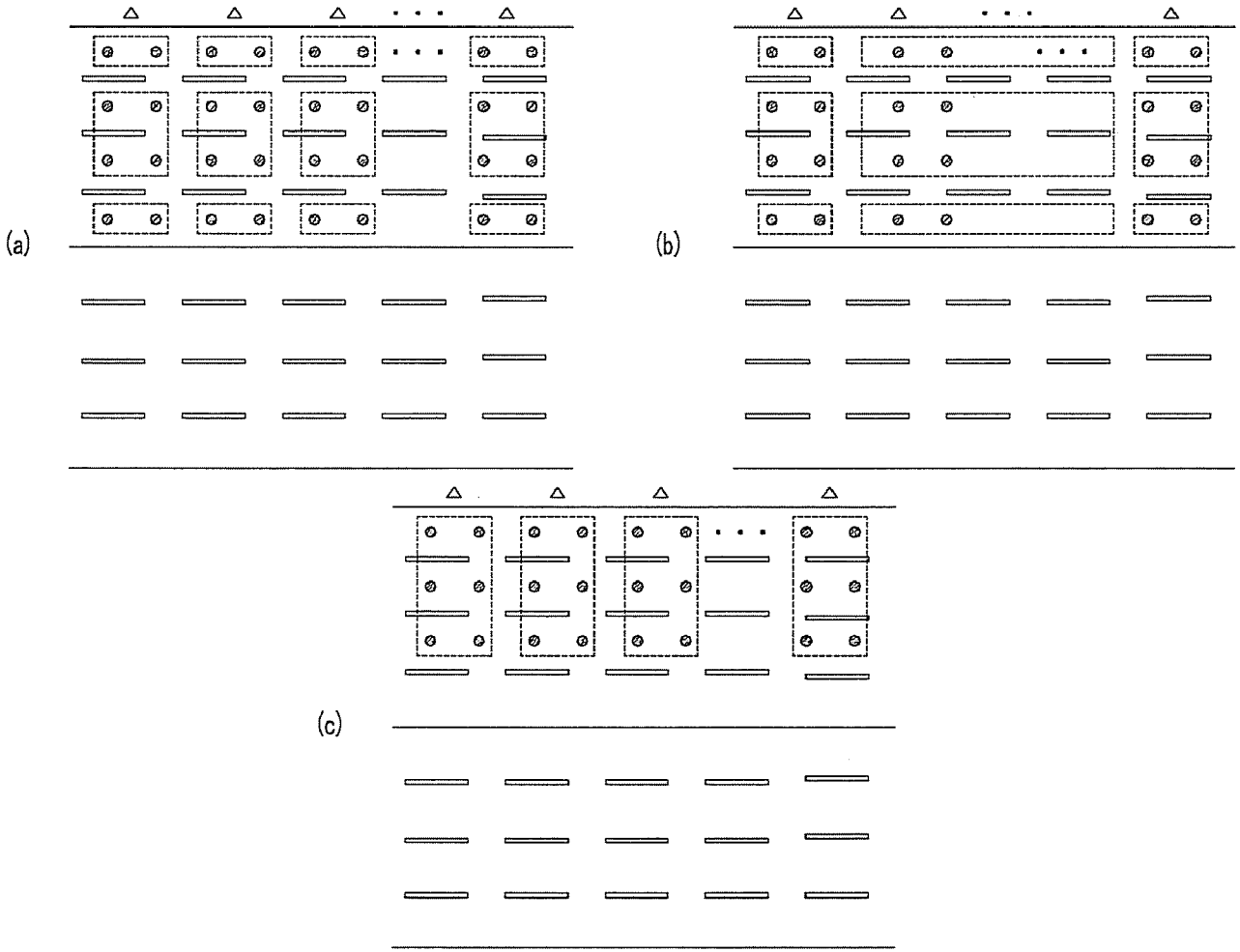
FIG. 4 is an example showing grouping of the vehicle detecting devices according to the exemplary embodiment of the present invention.

FIG. 4 is an example showing grouping of the vehicle detecting devices according to the exemplary embodiment of the present invention.

The roads on which the traffic signal controllers are installed may be classified into a first road on which the vehicles can travel only in one direction, and a second road on which the vehicles can travel in a straight direction and a turn direction, a third road on which the vehicles can travel in the straight direction, a first turn direction, and a second turn direction as in an intersection, etc., according to the characteristic of the roads. Each road includes the plurality of lanes, and the lanes may be classified into a straight lane, a first turn lane, and a second turn lane according to a travelling direction. In the exemplary embodiment of the present invention, in the lane of the third road such as the intersection, the first turn lane is a lane that can receive the traffic signal and a vehicle turns and travels in a predetermined direction, and the second turn lane is a lane where a vehicle can turn and travel in a predetermined direction regardless of the traffic signal. In different countries, the first turn lane may be a left turn lane or a right turn lane and the second turn lane may be a right turn lane or a left turn lane. Herein, an example in which the first turn lane is a left turn lane and the second turn lane is a right turn lane will be described.

In the exemplary embodiment of the present invention, the vehicle detecting devices may be grouped based on characteristics of roads, positions of vehicle detecting devices, vehicle incoming and outgoing information of roads on which the corresponding vehicle detecting devices are installed, and traffic. At this time, the number of vehicle detecting devices configuring each group is defined to be inversely proportional to the amount of traffic. In other words, the number of vehicle detecting devices is set so that if the traffic is heavy, the number of vehicle detecting devices is reduced, and if the traffic is light, the number of vehicle detecting devices is increased.

For example, as shown in FIG. 4(*a*), the vehicle detecting devices installed at a ramp of an intersection (third road) in rush hour where traffic is heavier than any set value are grouped to subdivide and detect the incoming and outgoing vehicles. In other words, when an arrow direction is a direction toward the intersection and the vehicle detecting devices are installed within the vehicle detecting section, the vehicle detecting devices are classified for each lane of each traveling direction (for example, straight lane, first turn lane, second turn lane) in consideration of the traveling directions of each road, and the vehicle detecting devices are grouped for each lane of the same traveling direction. In more detail, the vehicle detecting devices located at the detecting section (outgoing section) corresponding to a stop line nearest to the intersection and the vehicle detecting devices located at the detecting section (incoming section) farthest from the intersection are separately grouped into the first and second groups. The remaining vehicle detecting devices except for the vehicle detecting devices included in the first and second groups among the vehicle detecting devices in the entire vehicle detecting section are grouped according to the set number for grouping.

On the other hand, the vehicle detecting devices installed at a ramp of an intersection at a late hour when traffic is lighter than the set value are classified into each traveling direction (for example, straight lane, first turn lane, second turn lane) in consideration of the traveling directions of each road, and the vehicle detecting devices of each lane in the same traveling direction are grouped as shown in FIG. 4(*b*). In other words, the vehicle detecting devices located at the detecting section corresponding to a stop line nearest to the intersection and the vehicle detecting devices located at the detecting section farthest from the intersection are bound into a predetermined n number and are separately grouped into the first and second groups. The remaining vehicle detecting devices except for the vehicle detecting devices included in the first and second groups among the vehicle detecting devices in the entire vehicle detecting section are bound together such that they are grouped into one group.

Meanwhile, since the vehicle detecting devices installed on the road in one direction are installed on the road in the same traveling direction as shown in FIG. 4(*c*), they are grouped into a predetermined number for grouping according to a lane direction. The predetermined number for grouping is inversely proportional to traffic.

As described above, after the vehicle detecting devices are grouped, the controller 230 generates the activation control information and the transmission output setting information on each vehicle detecting device for each group. Herein, the activation control information may be classified for each constituent element of the corresponding vehicle detecting device, and includes time for activating or deactivating the corresponding constituent elements. For example, the activation control information includes first activation control information that activates or deactivates the constituent elements of the vehicle detecting devices detecting the incoming and outgoing of the vehicle, and second activation control information that activates or deactivates the constituent elements of the vehicle detecting device for communicating with the network operating system or the relaying device. Herein, the first activation control information includes a starting time for activating the corresponding constituent elements after receiving the first activation control information and activation duration, or a starting time for deactivating the corresponding constituent elements and deactivation duration, and further includes an instruction code that represents activation or deactivation. Further, the second activation control information may include the beacon tracking period for receiving the beacon signal, and if necessary, may further include the time or the instruction code that activates or deactivates the constituent elements of the vehicle detecting devices transmitting and receiving the detecting signal including the vehicle detecting information.

The transmission output setting information includes the power value consumed to allow the constituent elements to transmit the detecting signal of the vehicle detecting device.

The controller 230 determines the current signal state of the traffic signal controller based on the traffic signal information provided from the traffic signal controller 400, and determines whether the vehicle stops based on information on the determined the current signal state or the vehicle incoming and outgoing information provided from the vehicle detecting device included in a predetermined group, and then generates the activation control information of the vehicle detecting device of the corresponding group according to the determination result. Further, the controller 230 generates the transmission power setting information according to the traffic information calculated based on the vehicle incoming and outgoing information of vehicles provided from the vehicle detecting device. A method for generating the activation control information and the transmission power setting information according to the exemplary embodiment of the present invention will be described in detail below.

Meanwhile, the traffic signal information provided from the traffic signal controller 400 indicates the signal state indicated by the current traffic signal controller, that is, the traffic instruction signal. The traffic instruction signal may be generally classified into a stop signal, a straight signal, an alarm signal, and a turn signal that represents a turn direction, while the stop signal is mainly represented by red, the straight signal is mainly represented by green, the alarm signal is mainly represented by yellow, and the turn signal is mainly represented by green. Of course, the traffic signal information is not limited to the classified or represented one. The traffic signal information includes the indication change time that is changed by the following traffic instruction signal in addition to the current traffic instruction signal. The indication change time indicates time when the traffic instruction signal is changed from the present time to the following traffic instruction signal. In this case, the network operating system 200 can generate the activation control information based on the indication change time.

Meanwhile, the network operating system 200 transmits the beacon signal including the control information according to a predetermined communication protocol. The beacon signal is transmitted in the beacon transmission section that is an initial section of a super-frame. The beacon signal includes the network information and the control information for operating the sensor network. Therefore, the activation control information and the transmission power setting information generated by the network operating system 200 are included in the beacon signal transmitted every predetermined period, and can be provided to each vehicle detecting device.

Figure 5:
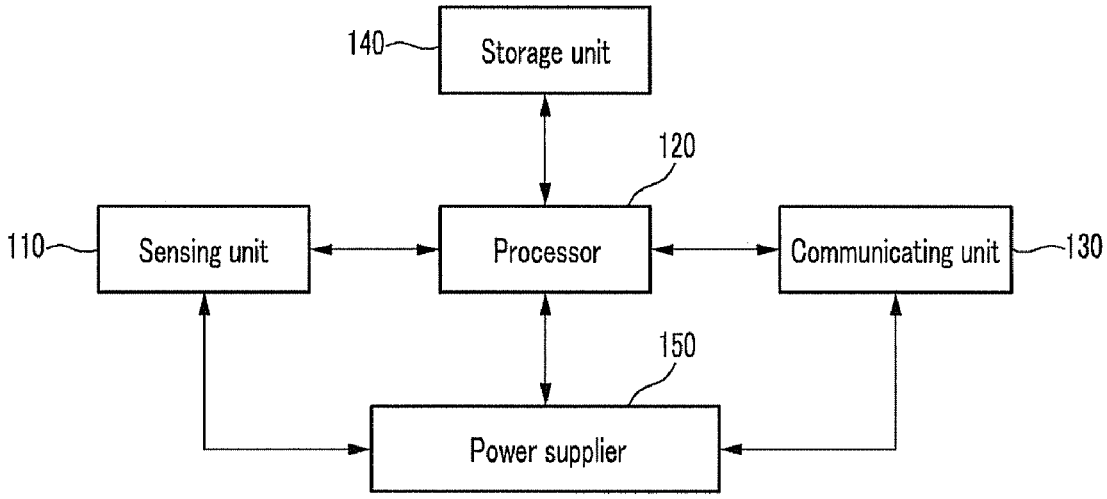
FIG. 5 is a diagram showing a structure of the vehicle detecting devices according to the exemplary embodiment of the present invention.

FIG. 5 is a diagram showing a structure of a vehicle detecting device 100 according to the exemplary embodiment of the present invention.

As shown in FIG. 5, the vehicle detecting device 100 according to the exemplary embodiment of the present invention includes a sensing unit 110 that senses vehicles, a processor 120 that processes data operations inside the sensing unit, a communicating unit 130 that transmits and receives data, a storage unit 140 that stores the data, and a power supplier 150 that supplies power.

The sensing unit 110 includes at least one sensor, and generates the sensing information according to the vehicle detection. The detailed structure and operation of the sensing unit is a technology that is known by those skilled in the art, and therefore the detailed description thereof will be omitted.

The power supplier 150 supplies power to the power detecting device 100, and supplies or interrupts power to the sensing unit 110 and the communicating unit 130 based on the control of the processor 120. Therefore, the sensing unit 110 and the communicating unit 130 can be activated or deactivated according to the interruption/application of power.

The communicating unit 130 receives the signal including the activation control information provided from the network operating system 200 or the beacon signal, or transmits the detecting signal including the vehicle detecting information generated in the processor 120 to the network operating system 200. In particular, the communicating unit 130 receives a signal from the network operating system 200 or transmits the predetermined signal through the signal transmission and reception with the relaying device 300.

The processor 120 generates the vehicle detecting information based on the sensing information collected through the sensing unit 110, and provides the generated vehicle detecting information to the network operating system 200 through the communicating unit 130. To this end, the processor 120 sets the communication channel with the predetermined relaying device 300 and transmits the vehicle detecting information to the corresponding relaying device 300 through the set communication channel, and the relaying device 300 then transmits the received vehicle detecting information to the network operating system 200. The vehicle detecting information includes the incoming and outgoing information of vehicles traveling on the corresponding road. The incoming and outgoing information of vehicle may further include a time when vehicles enter the sensing area that is detectable by the corresponding vehicle detecting device and a time when vehicles are out of the corresponding sensing area, or may further include the identification numbers of incoming and outgoing vehicles with regard to the corresponding sensing area.

Meanwhile, the processor 120 activates or deactivates the sensing unit 110 and the communicating unit 130 based on the control information provided from the network operating system 200, and controls the transmission output of the communicating unit 130.

For example, the processor 120 changes the operating mode of the sensing unit 110 into a normal mode/slip mode based on the activation control information provided from the network operating system 200, and controls the power supplier 150 based on the operating mode to activate or deactivate the sensing unit 110. In other words, the processor 120 operates the sensing unit 110 in the slip mode and the normal mode according to the predetermined sensing period. In the case of the slip mode, power supplied to the sensing unit 110 is interrupted, and in the normal mode, the power supplier 150 can be controlled so that power is supplied to the sensing unit 110.

When the processor 120 receives the first activation control information from the network operating system 200, it activates or deactivates the sensing unit 110 for the corresponding time according to the start time, the duration, and the instruction code included in the first activation control information. Therefore, although the current sensing unit 110 is activated according to the predetermined sensing period and is operated in the normal mode, when the first activation control information including the time together with the instruction code indicating the deactivation from the network operating system 200 is received, the sensing unit 110 is deactivated during the duration from the start time instructed by the first activation control information and is operated in the slip mode. Further, although the current sensing unit 110 is activated according to a predetermined sensing period and is operated in the slip mode, when the first activation control information including the time together with the instruction code indicating the activation from the network operating system 200 is received, the sensing unit 110 is activated during the duration from the start time instructed by the first activation control information and is operated in the normal mode.

Herein, the slip mode may mean the operating mode that operates the vehicle detecting device 100 at only the minimum power by deactivating the sensing unit 110 and allowing the processor 120 to perform only minimum operations.

Further, the processor 120 controls the period where the communicating unit 130 receives the beacon signal according to the second activation information provided from the network operating system 200. In other words, the communicating unit 130 is activated by supplying power to the communicating unit 130 every beacon tracking period included in the second activation information to receive the beacon signal transmitted from the network operating system 200 through the relaying device 300. Therefore, the vehicle detecting device 100 applies power to the communicating unit 130 according to the control information provided from the network operating system, such that it can be operated at low power. In other words, it can receive the beacon signal once in every n beacon period without receiving the beacon signal at every beacon period based on the second activation information.

Meanwhile, when the second activation control information includes the start time that controls the transmission and reception time for the communication of the vehicle detecting device and the duration and the instruction code indicating the activation or the deactivation, the processor 120 can activate the communicating unit 130 during the duration from the starting time of the second activation control information according to the instruction code to transmit and receive the vehicle detecting information or deactivate the communicating unit 130 for the duration to not transmit and receive the vehicle detecting information. In this case, although the vehicle detecting information is generated, the corresponding vehicle detecting information cannot be transmitted to the network operating system 200 according to the second activation information.

Further, the processor 120 controls the transmission power of the communicating unit 130 according to the transmission power setting information applied from the network operating system 200. In other words, the processor differently sets the transmission power of the detecting signal according to the control information to transmit the detecting signal.

Next, a method for running a sensor network system for a telematics service according to an exemplary embodiment of the present invention will be described.

Figure 6:
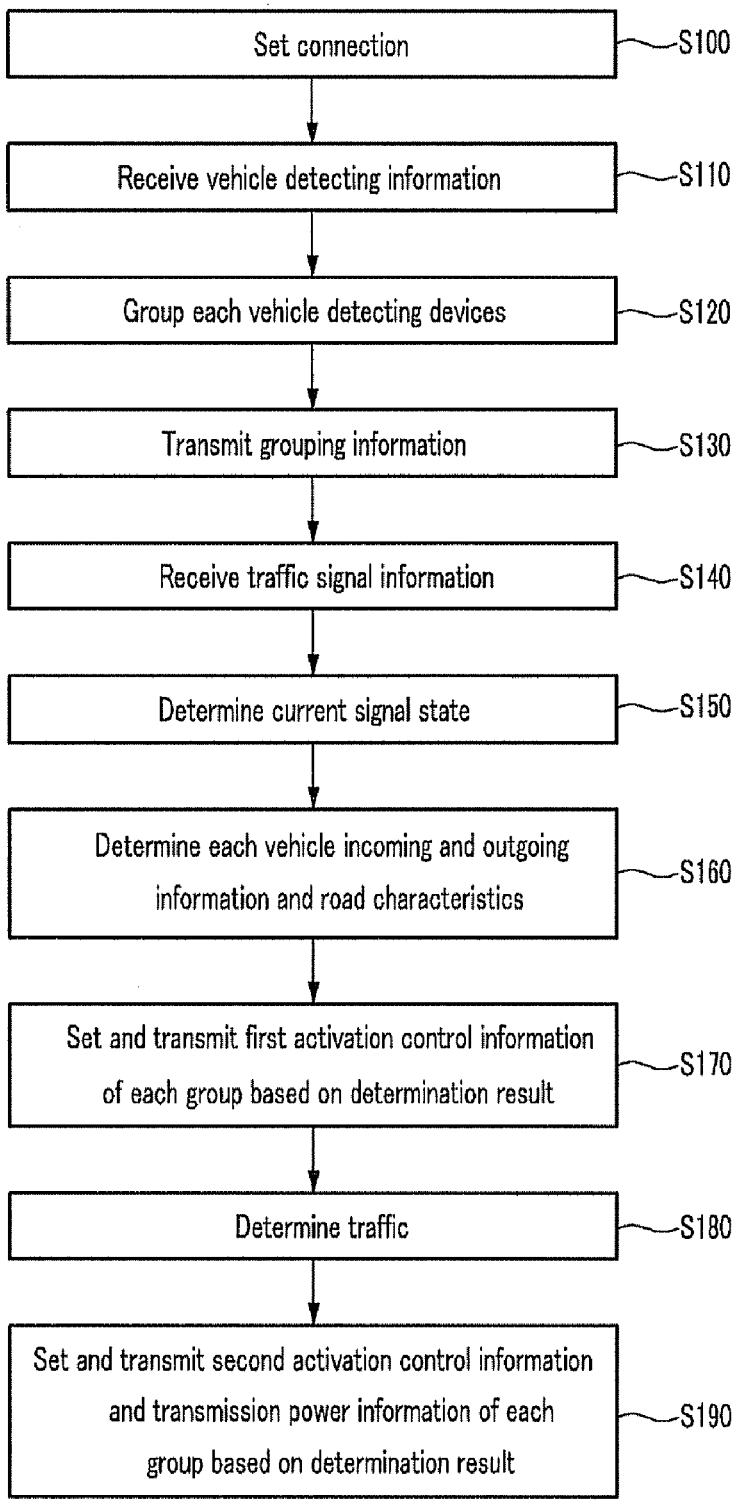
FIG. 6 is a flowchart of a running method according to an exemplary embodiment of the present invention.

FIG. 6 is a flow chart of an operating method according to exemplary embodiment of the present invention.

The network operating system 200 transmits the beacon signal including the control information according the predetermined communication protocol. The network operating system starts to transmit the beacon signal by first configuring the sensor network and the vehicle detecting device 100, or the relating device 300 receives the beacon signal and sets the device transmitting the beacon signal to a parent device and then performs the connection to the corresponding parent device. If the connection is successfully made, a portion of the vehicle detecting device or the roadside relaying device performs a relaying function of transmitting the beacon signal provided from the corresponding parent device to other devices. As such, the vehicle detecting device or the relaying device transmits the beacon signal, making it possible to extend the sensor network beyond the communication area of the network operating system.

As such, in the state where the sensor network is formed based on the vehicle detecting device and the relaying devices (S100), the network operating system 200 groups the vehicle detecting devices based on the vehicle detecting information transferred from the relaying device or the vehicle detecting device, and the traffic information calculated based on the vehicle detecting information and the characteristics of the roads on which the vehicle detecting devices configuring the sensor network are installed and the positions of the vehicle detecting devices (S110 to S120). The grouping can be dynamically changed. In other words, the vehicle detecting devices installed on a predetermined road can be differently grouped at each time, for example, the vehicle detecting devices are grouped at the first time (rush hour) as shown in FIG. 4(*a*), and the vehicle detecting devices can be grouped at the second time (late hour) as shown in FIG. 4(*b*). The grouping information may be stored in the storage unit 210 for use. Meanwhile, the network operating system 200 can perform the grouping and then transmit the grouped information for each group. The grouping information may include the identification information of the group and the identification information of the vehicle detecting devices belonging to the corresponding group. Therefore, it can be appreciated that the vehicle detecting devices belong to a group based on the grouping information, and then only when the control information provided from the network operating system 200 includes its own group identification information can the vehicle detecting devices be operated according to the corresponding control information.

Thereafter, the network operating system 200 determines the signal state of the current traffic signal controller based on the traffic signal information provided from the traffic signal controller 400 (S130-S140). The traffic signal information includes the traffic instruction signal that is information currently displayed in the traffic signal controller and the time when the traffic instruction signal is changed from the present time to the next traffic instruction signal.

The network operating system 200 receives the vehicle incoming and outgoing information provided from the vehicle detecting devices of each group, and determines the road characteristics of each group (S150). The activation control information of each group is set based on at least one of the determined vehicle incoming and outgoing information, the road characteristics, and the current signal state of the traffic signal controller (S160). In other words, the network operating system 200 deactivates the sensing unit in the vehicle detecting devices of the corresponding group until the stop signal is changed into a straight signal or a turn signal that represents travelling, when it is determined that the traffic instruction signal is a stop signal state and the vehicles stop based on the vehicle incoming and outgoing information.

In detail, when the traffic instruction signal that represent the current signal state is a stop signal (e.g., red), the road on which the vehicle detecting devices of the predetermined group are installed is a straight lane, and it is determined that since the incoming of vehicles into the detecting area of the corresponding group is detected according to the vehicle incoming and outgoing information and the outgoing thereof is not detected, the vehicle stops, the network operating system 200 generates the first activation control information for deactivating the sensing units in the vehicle detecting devices of the corresponding group until the current traffic instruction signal is changed to the traffic instruction signal corresponding to the straight signal (for example, green). The first activation control information generated is transmitted to the vehicle detecting devices 100 of the corresponding group. In this case, the first activation control information includes the deactivation starting time and the duration together with the instruction code that represents deactivation, or may include the identification information of the vehicle detecting devices included in the corresponding group or the identification information of the corresponding group. Herein, the deactivation starting time represents the present time, and the duration represents the ending of the stop signal of the traffic instruction signal.

Therefore, the vehicle detecting devices having the corresponding identification information or the vehicle detecting devices included in the identification information of the predetermined group operate its own sensing unit in a slip mode according to the first activation control information, and deactivates it during the control time.

If it is determined that the traffic instruction signal representing the current signal state is a travelling signal (e.g., green) and there is no vehicle in the entire vehicle detecting section in which the vehicle detecting devices are installed, since the incoming of vehicles into the detecting area of the corresponding group is detected according to the vehicle incoming and outgoing information and the outgoing thereof is not detected, the vehicle stops according to the vehicle incoming and outgoing information, and the network operating system 200 generates the first activation control information for activating the sensing unit in the vehicle detecting device of the group that is installed in a section farthest from the intersection to detect the incoming of vehicles into the area and transmits the first activation control information to the vehicle detecting devices 100 of the corresponding group. In this case, the first activation control information includes the starting time that is a present time for activation and the duration that is the residual green signal time together with the instruction code that represents activation, or may include the identification information of the vehicle detecting devices included in the corresponding group or the identification information of the corresponding group. Herein, the residual green signal time represents the time when the traffic instruction signal is changed from the green signal to the next signal from the present time.

At this time, the network operating system 200 generates the first activation control information for deactivating the vehicle detecting device of groups other than the group that is installed in a detecting section farthest from the intersection to detect the incoming of vehicles into the area, and transmits the first activation control information to the vehicle detecting devices of the corresponding group. In this case, the first activation control information includes the instruction code that represents deactivation, the deactivation starting time that is a present time for activation, and the present time that is the residual green signal time together, or may include the identification information of the vehicle detecting devices included in the corresponding group or the identification information of the corresponding group.

If there is no vehicle in the entire vehicle detecting section and the currently displayed information, that is, the traffic instruction signal, is a travelling signal such that the sensing units in the vehicle detecting devices of the group installed in the section farthest from the intersection to detect the incoming of vehicles into the area are activated and the sensing units in the vehicle detecting devices of other groups are deactivated, when at least one of the vehicle detecting devices that are installed in the section farthest from the intersection to detect the incoming of vehicles into the area detects the incoming of vehicles, the network operating system 200 recognizes that the vehicles enter the vehicle detecting section and activates the sensing units of all the vehicle detecting devices in the vehicle detecting section. In other words, in order to activate the sensing units for vehicle detection in the vehicle detecting devices of groups other than the previously activated group detecting the incoming of vehicles into the area, the first activation control information is generated and the first activation control information is transmitted to the vehicle detecting device of the corresponding group. In this case, the first activation control information includes the starting time that is a present time and the duration that is a residual green time together with the instruction code that represents activation, or may include the identification information of the vehicle detecting devices included in the corresponding group or the identification information of the corresponding group.

In addition, when the traffic instruction signal representing the current signal state is a stop signal (e.g., red), a road on which the vehicle detecting devices of a predetermined group are installed is a first turn lane that indicates a left turn at an intersection, and it is determined that since the incoming of vehicles into the detecting area of the corresponding group is detected according to the vehicle incoming and outgoing information and the outgoing thereof is not detected, the vehicle stops, and the network operating system 200 generates the first activation control information for deactivating the sensing units in the vehicle detecting devices of the corresponding group until the current traffic instruction signal is changed to the traffic instruction signal corresponding to the turn signal (for example, green arrow). The generated first activation control information is transmitted to the vehicle detecting devices 100 of the corresponding group. Therefore, the vehicle detecting devices having the corresponding identification information or the vehicle detecting devices included in the identification information of the predetermined group operate their sensing units at a slip mode according to the first activation control information, and deactivate the sensing units for the control time.

Further, when the traffic instruction signal representing the current signal state is a stop signal (e.g., red), and a road on which the vehicle detecting devices of a predetermined group are installed is a second turn lane where the vehicles can turn regardless of the traffic instruction signal, the network operating system 200 generates the first activation control information for continuously activating the sensing units in the vehicle detecting devices of the corresponding group until the stop signal that is the current traffic instruction signal is changed to another signal. In this case, when a road on which the vehicle detecting devices of the predetermined group are installed is an intersection, the network operation system 200 can activate the sensing unit in the vehicle detecting devices until the stop signal is changed to another signal, or when the installed road is the first road on which the vehicles can travel in only one direction or the second road on which the vehicles can be traveled in a straight direction and a turn direction, the network operating system 200 can activate the sensing unit in the vehicle detecting units until the signal state of the traffic signal controller is changed from the stop signal to the straight signal.

Therefore, the vehicle detecting devices having the corresponding identification information or the vehicle detecting devices included in the identification information of the predetermined group continuously operate their sensing units at a normal mode according to the first activation control information and activate the sensing units.

With the operation of the vehicle detecting devices as described above, when the incoming and outgoing of the vehicle does not occur according to the signal state of the traffic signal controller and the vehicle stops, or there are no vehicles in the entire vehicle detecting sections in which the vehicle detecting devices are installed, the vehicle detecting devices does not perform the sensing operation that detects the vehicles, such that the adaptive power control of the vehicle detecting device can be made.

Meanwhile, as described above, the network operating system 200 generates the second activation control information and the transmission power setting information according to traffic based on the vehicle incoming and outgoing information provided from the vehicle detecting devices of the corresponding group while generating the first activation control information for each group (S190).

For this purpose, the network operating system 200 calculates traffic based on the vehicle incoming and outgoing information provided from the vehicle detecting devices for each group. The traffic information can be calculated based on the vehicle incoming and outgoing information, including the number of vehicles incoming and outgoing into the detecting area on a road, on which the corresponding vehicle detecting devices are installed, per a set time.

Next, the network operating system 200 sets the transmission power information based on the calculated traffic of the group (S190).

Figure 7:
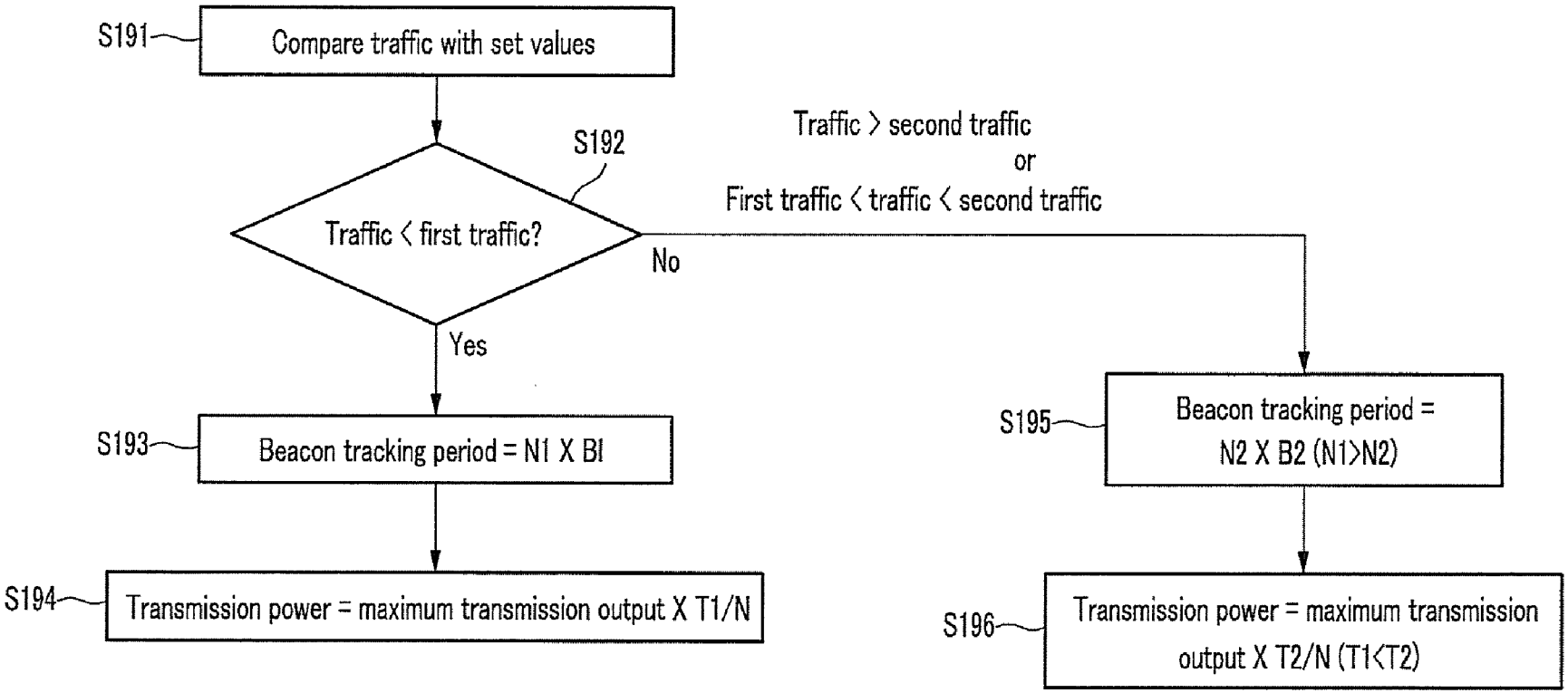
FIG. 7 is a flowchart showing a transmission power setting process according to the exemplary embodiment of the present invention shown in FIG. 6.

FIG. 7 is a flowchart showing the beacon tracking period and the transmission power setting process among the second activation information according to the exemplary embodiment of the present invention.

As shown in FIG. 7, the network operating system 200 compares the determined traffic with the set first and second traffic, respectively (S191). Herein, the relationship of the first traffic<the second traffic is established. When the traffic of the predetermined group is lighter than the first traffic, the beacon tracking period among the second activation information of the corresponding group is set as follows (S192-S193).

$$\text{Beacon tracking period}=N1\times BI \quad \text{[Equation 1]}$$

Herein, N1 is an integer as a set value and BI is the beacon signal transmission period set in the network operating system, and the network operating system transmits the beacon signal at every B1.

Further, when the traffic of the predetermined group is lighter than the first traffic, the transmission power setting information of the corresponding group is set as follows (S194).

$$\text{Transmission power}=\text{maximum transmission output}\times T1/N \quad \text{[Equation 2]}$$

T1 and N are integers as set values, and N is number classifying traffic and is the number of traffic classified in the network operating system. In other words, when the traffic is classified as the first traffic, the second traffic, the third traffic. N is 3.

Meanwhile, when the traffic of the predetermined group is heavier than the first traffic and lighter than the second traffic, the second activation information of the corresponding group, that is, the beacon tracking period, is set as follows (S195).

$$\text{Beacon tracking period}=N2\times BI \quad \text{[Equation 3]}$$

Herein, N2 is an integer as a set value and BI is the beacon signal transmission period set as a reference in the system. The relationship of N1>N2 is established.

Further, when the traffic of the predetermined group is heavier than the first traffic and lighter than the second traffic, the transmission power setting information of the corresponding group is set as follows (S196).

$$\text{Transmission power}=\text{maximum transmission output}\times T2/N \quad \text{[Equation 4]}$$

Herein, T2 is an integer as a set value, and the relationship of T1<T2 is obtained.

As described above, the set second activation control information may include the identification information of the vehicle detecting devices included in the corresponding group or the identification information of the corresponding group together with the calculated beacon tracking period. Further, the transmission power setting information set as described above may include the identification information of the vehicle detecting devices included in the corresponding group or the identification information of the corresponding group together with the set transmission power value.

Therefore, the vehicle detecting devices having the corresponding identification information or the vehicle detecting devices included in the identification information of the predetermined group operate the communicating unit 130 according to the beacon tracking period included in the second activation control information to receive the beacon signal transmitted from the network operating system 200.

Further, the vehicle detecting devices having the corresponding identification information or the vehicle detecting devices included in the identification information of the predetermined group control the transmission power of the detecting signal including its own vehicle detecting information according to the transmission power setting information to transmit the detecting signal.

As described above, when the traffic is light according to the operation of the vehicle detecting devices, the vehicle detecting devices are operated at a longer beacon tracking period to receive the beacon signal and transmit it at the relatively lower transmission power of the detecting signal, and when the traffic is heavy, the vehicle detecting devices receive the beacon signal at a shorter beacon tracking period and transmit it at the relatively higher transmission power of the detecting signal, such that the adaptive power control of the vehicle detecting device depending on the traffic can be achieved.

As described above, the second activation control information may further include the instruction code activating or deactivating the component of the vehicle detecting device, that is, the communicating unit that transmits the detecting signal including the vehicle detecting information, or receives the predetermined information from the network operating system 200, the activated or deactivated starting time, and the duration, if necessary, in addition to the beacon tracking period receiving the beacon signal, In this case, the transmitting operation and receiving operation of the communicating unit can be activated or deactivated separately.

The second activation control information on the predetermined vehicle detecting device based on at least one of the traffic and the vehicle incoming and outgoing information can be generated. In addition, the second activation control information can be generated by being linked with the processing of the first activation control information, that is, at least one of the transmitting operation or the receiving operation of the vehicle detecting device can be activated or deactivated by being linked with the activation or the deactivation of the sensing operation of the vehicle detecting device. For example, when the sensing operation of the vehicle detecting device detecting the vehicles does not occur, the second activation control information that deactivates at least one of the transmitting operation of transmitting the information detected by the corresponding vehicle detecting device to the network operating system 200 or the receiving operation of receiving the predetermined information from the system 200 is generated and can be transmitted to the corresponding vehicle detecting device. Of course, when the sensing operation of the corresponding vehicle detecting device is back-activated, the transmitting operation or the receiving operation of the corresponding vehicle detecting device can be activated based on the second activation control information.

With the exemplary embodiment of the present invention, when the vehicle detecting devices form the sensor network to detect vehicles, it is possible to efficiently use the energy of the vehicle detecting devices using the position, time, traffic, vehicle incoming and outgoing detecting information of the vehicle detecting device.

The above-mentioned exemplary embodiments of the present invention are not only embodied only by a method and apparatus. Alternatively, the above-mentioned exemplary embodiments may be embodied by a program performing functions that correspond to the configuration of the exemplary embodiments of the present invention, or a recording medium on which the program is recorded. These embodiments can be easily devised from the description of the above-mentioned exemplary embodiments by those skilled in the art to which the present invention pertains.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. In a system forming a sensor network between vehicle detecting devices that are installed on a road to detect vehicles, a method for running a network linked with a traffic signal controller installed on a road to control the vehicle detecting devices, comprising:

classifying the vehicle detecting devices forming the sensor network into a plurality of groups by the system;

determining a current signal state based on traffic signal information provided from the traffic signal controller by the system;

generating first activation control information that allows the vehicle detecting device to activate or deactivate a sensing operation of detecting vehicles for each group by the system, based on the current signal state of the determined traffic signal controller and vehicle incoming and outgoing information provided from the vehicle detecting devices of each group;

generating transmission output setting information includes a transmission power value that allows the vehicle detecting devices to transmit a detecting signal including the vehicle incoming and outgoing information; and transmitting the first activation control information including an instruction code indicating the activation or deactivation and an activated or no-activated starting time and duration for each group by the system and the transmission output setting information.

2. The method for running a network of claim 1, wherein the classifying classifies the vehicle detecting devices into predetermined groups based on characteristics of a road on which each vehicle detecting device is installed, a position on which each vehicle detecting device is installed, vehicle incoming and outgoing information to and from the road on which each vehicle detecting device is installed, and traffic.

3. The method for running a network of claim 2, wherein the classifying classifies the vehicle detecting devices installed on a road for each lane in consideration of a vehicle traveling direction of each road, and classifies the corresponding vehicle detecting devices into a plurality of groups for each lane in the same traveling direction.

4. The method for running a network of claim 2, further comprising grouping the vehicle detecting devices installed on a road for each time using different methods, and transmitting information according the grouping to each vehicle detecting device whenever the grouping is performed.

5. The method for running a network of claim 2, wherein the number of groups is inversely proportional to traffic.

6. The method for running a network of claim 2, wherein, when the vehicle detecting devices are installed in a vehicle detecting section of a ramp of an intersection and traffic is heavier than a set value, the classifying includes:

grouping the vehicle detecting devices located at a detecting section corresponding to a stop line nearest to the intersection and the vehicle detecting devices located at a detecting section farthest from the intersection among the vehicle detecting sections into a first group and a second group, respectively; and grouping the remaining vehicle detecting devices except for the vehicle detecting devices included in the first and second groups among the vehicle detecting devices in the vehicle detecting section into a plurality of groups by binding the remaining vehicle detecting devices by a set number in order to group them.

7. The method for running a network of claim 2, wherein, when the vehicle detecting devices are installed in the vehicle detecting section of the ramp of the intersection and traffic is lighter than a set value, the classifying includes:

grouping the vehicle detecting devices located at a detecting section corresponding to a stop line nearest to the intersection and the vehicle detecting devices located at a detecting section farthest from the intersection among the vehicle detecting sections into a first group and a second group, respectively, by binding them by a set number in order to group them; and forming the remaining vehicle detecting devices except for the vehicle detecting devices included in the first and second groups among the vehicle detecting devices in the vehicle detecting section into one group by binding all the remaining vehicle detecting devices.

8. The method for running a network of claim 2, wherein, when the vehicle detecting devices are installed in the vehicle detecting section on a single direction road, the vehicle detecting devices are classified in a plurality of groups according to a lane direction by binding them into a predetermined number in order to group them.

9. The method for running a network of claim 1, wherein the generating the first activation control information generates the first activation control information that deactivates the sensing operation of the vehicle detecting devices of the corresponding group until a stop signal is changed to a straight signal or a turn signal that indicates traveling, if it is determined that the signal state of the traffic signal controller is a stop signal and the vehicles stop based on the vehicle incoming and outgoing information of the corresponding group.

10. The method for running a network of claim 1, wherein the generating the first activation control information generates the first activation control information that activates the sensing operation until the signal state is changed from a stop signal to any other signals, when the signal state of the traffic signal controller is a stop signal and the road on which the vehicle detecting devices of the corresponding group are installed is a lane that allows for turn regardless of the traffic indicating signal.

11. The method for running a network of claim 1, wherein, if it is determined that the signal state of the traffic signal controller is a travelling signal and there are no vehicles in the vehicle detecting section of the intersection in which the vehicle detecting devices are installed, the generating the first activation control information includes generating the first activation control information in order to activate the sensing operation of the vehicle detecting devices of the group installed in the detecting section farthest from the intersection among the vehicle detecting sections, and generating the first activation control information in order to deactivate the sensing operation of the remaining vehicle detecting devices except for the vehicle detecting devices included in the group installed in the farthest detecting section among the vehicle detecting devices installed in the vehicle detecting section.

12. The method for running a network of claim 11, further comprising, when at least one vehicle detecting device of the group installed in the farthest detecting section detects the incoming of vehicles, generating the first activation control information in order to activate the sensing operation of the remaining vehicle detecting devices.

13. The method for running a network of claim 1, wherein the generating of transmission output setting information comprising:

calculating traffic based on the incoming and outgoing information of vehicles provided from the vehicle detecting devices of each group; and setting a beacon tracking period that receives a beacon signal provided from the system and transmission power value that transmits the detecting signal including the incoming and outgoing information of vehicles by the vehicle detecting device of the corresponding group, based on the calculated traffic, wherein the transmitting further includes transmitting the second activation control information including the predetermined beacon tracking period.

14. The method for running a network of claim 13, wherein the setting the beacon tracking period and the transmission power value includes at least one of:

when the calculated traffic of the group is smaller than the set first traffic, setting the beacon tracking period of the corresponding group to N1×BI (where N1 is an integer as a set value and BI is the beacon signal transmission period set in the system);

when the calculated traffic of the group is even smaller than the set first traffic, setting the transmission power of the corresponding group to the maximum transmission output×T1/N (where T1 is an integer as a set value and N is a division number of traffic);

when the calculated traffic of the group is larger than the set first traffic and smaller than the second traffic, setting the beacon tracking period of the corresponding group to N2×BI (where N2 is an integer as a set value and BI is a beacon signal transmission period set in the system, N1>N2); and when the calculated traffic of the group is larger than the set first traffic and smaller than the second traffic, setting the transmission power of the corresponding group to the maximum transmission output×T2/N (where T2 is an integer as a set value T1<T2).

15. The method for running a network of claim 13, wherein the second activation control information further includes the instruction code that allows the vehicle detecting device to transmit the detecting signal including the vehicle detecting information and to activate or deactivate the operation of receiving the information from the system, the activated or deactivated starting time, and the duration.

16. A network operating system linked with a traffic signal controller installed on a road to control vehicle detecting devices when a sensor network is formed between vehicle detecting devices that are installed on the road to detect vehicles, comprising:

a grouping unit that classifies each vehicle detecting device in a plurality of groups;

a controller that generates activation control information and transmission output setting information on the vehicle detecting devices for each group, based on one of a current signal state of the traffic signal controller and vehicle incoming and outgoing information provided from the vehicle detecting devices of each group, and traffic information; and a communicating unit that transmits the activation control information and the transmission output setting information to the vehicle detecting devices of each group and receives the vehicle incoming and outgoing information provided from each vehicle detecting device to transmit it to the controller, wherein the activation control information includes at least one of first activation control information that allows the vehicle detecting device of the corresponding group to activate or deactivate the sensing operation of detecting vehicles and second activation control information that allows the vehicle detecting devices to indicate a beacon tracking period for receiving a beacon signal provided from the system, and the transmission output setting information includes a transmission power value that allows the vehicle detecting devices to transmit the detecting signal including the vehicle incoming and outgoing information.

17. The network operating system of claim 16, wherein the second activation control information further includes information that activates or deactivates an operation of transmitting the detecting signal including the vehicle detecting information of the vehicle detecting device and receiving the information from the system, and the first and second activation information includes an instruction code indicating activation or deactivation for each group and an activation or deactivation starting time and duration.

18. The network operating system of claim 16, wherein the controller, when the calculated traffic of the group is smaller than the set first traffic based on the incoming and outgoing information of vehicles, sets the beacon tracking period of the corresponding group to N1×BI (where N1 is an integer as a set value and BI is the beacon signal transmission period set in the system), and when the calculated traffic of the group is larger than the set first traffic and smaller than the second traffic, sets the beacon tracking period of the corresponding group to N2×BI (where N2 is an integer as a set value and BI is a beacon signal transmission period set in the system, N1>N2).

19. The network operating system of claim 16, wherein the controller, when the calculated traffic of the group is smaller than the set first traffic based on the incoming and outgoing information of vehicles, sets the transmission power of the corresponding group to the maximum transmission output× T1/N (where T1 is an integer as a set value and N is a division number of traffic), and when the calculated traffic of the group is larger than the set first traffic and smaller than the second traffic, sets the transmission power of the corresponding group to the maximum transmission output×T2/N (where T2 is an integer as a set value, T1<T2).

* * * * *